US005396845A

United States Patent [19]

Backstein et al.

[11] Patent Number: 5,396,845

[45] Date of Patent: Mar. 14, 1995

[54] MODULAR FUZE

[75] Inventors: Günter Backstein, Meerbusch; Hermann Schaper, Vallendar; Dirk Wolff, Koblenz, all of Germany

[73] Assignee: Rheinmetall GmbH, Ratingen, Germany

[21] Appl. No.: 46,859

[22] Filed: Apr. 14, 1993

[30] Foreign Application Priority Data

Apr. 14, 1992 [DE] Germany ..... 42 12 454.9

[51] Int. Cl.[6] ..... F42C 11/06

[52] U.S. Cl. ..... 102/427; 102/260; 102/425; 102/420; 102/418; 89/6

[58] Field of Search ..... 102/419, 427, 276, 206, 102/202.14, 416, 418, 420, 424, 425, 428, 260, 275.9; 89/6; 112/265

[56] References Cited

U.S. PATENT DOCUMENTS

| | | | |
|---|---|---|---|
| 2,358,647 | 9/1944 | Kula | 102/260 |
| 3,371,579 | 3/1968 | Kinzelman | 89/6 |
| 3,815,271 | 7/1974 | Lynn | 33/241 |
| 4,926,750 | 5/1990 | Van Sloun | 102/261 |
| 5,147,973 | 9/1992 | Ziemba | 102/214 |

FOREIGN PATENT DOCUMENTS

| | | | |
|---|---|---|---|
| 86986 | 8/1983 | European Pat. Off. | 102/427 |
| 0284715 | 10/1988 | European Pat. Off. . | |
| 3344750A1 | 6/1985 | Germany . | |
| 3720133 | 7/1988 | Germany | 102/276 |
| 8401619 | 4/1984 | WIPO . | |

*Primary Examiner*—Stephen M. Johnson
*Attorney, Agent, or Firm*—Spencer, Frank & Schneider

[57] ABSTRACT

A fuze or igniter provided with an adjustable electronic unit (24), a separate energy supply (40) as well as a mechanical safety device (26). In order for this fuze to be independent of the weapons system and not be bound to a particular type of payload, the adjustable electronic unit (24) and the mechanical safety device (26) are accommodated in the essentially cylindrical, watertight housing (22) of a basic module (20) that has two end faces (28, 30). The energy supply (40) can be mechanically and electrically connected with the basic module (20). In the region of one of its end faces (28), the basic module (20) can be connected with either a programming device (136) in order to program in an ignition time and a sterilization time (desensitization time) or a payload (42) that is independent of the weapons system employed and is not ammunition specific. In the region of its other end face (30), the basic module (20) can be connected with at least one additional module (50, 62, 76) for use with the payload (42).

13 Claims, 4 Drawing Sheets

MODULAR FUZE

BACKGROUND OF THE INVENTION

The present invention relates to a fuze or igniter of the type including an adjustable electronic unit, an energy supply and a mechanical safety device.

Such fuzes or igniters are known in various embodiments for a variety of weapons systems. For example, U.S. Pat. Nos. 4,702,169 and 4,712,478 disclose such a fuze for land mines. Reference is also made to the various types of fuzes of this type or species which have become known in connection with "intelligent" artillery projectiles.

One drawback of all of these fuzes is that they are optimized for the respective weapons system or the respective type of ammunition, so that they accordingly can be employed only there because, for weapons technology and economic reasons, they are designed for a specific case of use. A use of this type of fuze for different weapons systems and ammunition types is not possible.

SUMMARY OF THE INVENTION

It is therefore an object of the present invention to develop an fuze of the type initially mentioned above which can be employed for payloads, e.g., active charges, of the most varied type which are independent of a particular weapons system and are not bound to a particular type of ammunition and can, moreover, be employed safely and manipulated easily, in particular, with payloads that are deployed by personnel.

The above object is generally achieved according to the present invention by a modular fuze which comprises: a basic module having an essentially cylindrical water tight housing with first and second end surfaces; an adjustable electronic unit for controlling the firing time of the fuze disposed in the housing; first connecting means disposed in the region of the first end surface of the housing for mechanically connecting the housing and functionally connecting the electronic unit with one of a programming device for programming a firing time and a desensitization time into the electronic unit, and a payload which is independent of the weapon system employed and is not ammunition specific; second connecting means disposed in the region of the second end surface of the housing for mechanically connecting the housing and electrically connecting the adjustable electronic unit to a housing and electronic circuit, respectively, of at least one further module for the fuze; a mechanical safety device, disposed in the cylindrical housing of the basic module and deactivatable from the exterior of the housing, for preventing firing of a payload connected to the housing until deactivated; a separate energy supply; and means for mechanically and electrically connecting the energy supply with the housing of the basic module and with the electronic unit.

A particular advantage of this fuze or igniter is its modular structure which makes it possible to employ a basic module which, if required, may be connected with at least one additional module so that an fuze is made available which can be used in many ways, for ammunition that is not weapon specific, and for the most varied uses on land or under water. The fuze according to the invention can therefore be employed together with destructive charges, interference charges, so-called EOD explosives, camouflaging charges, sticking charges, signaling charges, blasting shears and the like.

Moreover, the fuze or igniter is designed to be particularly safe since, in addition to the firing or ignition timing, a desensitization time is also adjustable, that is, a maximum service life/function duration of the fuze after it has been armed. It is particularly advantageous that, once the instant of desensitization has been reached, the energy supply thus far connected with the fuze is severed. This precludes further supply of energy to the fuze, so that no ignition or firing can take place any longer, and the fuze is then no longer armed and can be re-used, if desired, after recovery. The arming of this fuze takes place only after the occurrence of a firing signal.

The mechanical safety setting is easily manipulated. Moreover, it is designed in such a way that renewed packaging of a pre-armed or partially armed fuze is prevented. This is possible only after the fuze has been made completely safe.

The invention will be described below in greater detail with reference to an embodiment thereof that is illustrated in the attached drawings.

FIGS. *2a* and *2b* show a safety device for the fuze.

Figure 1:
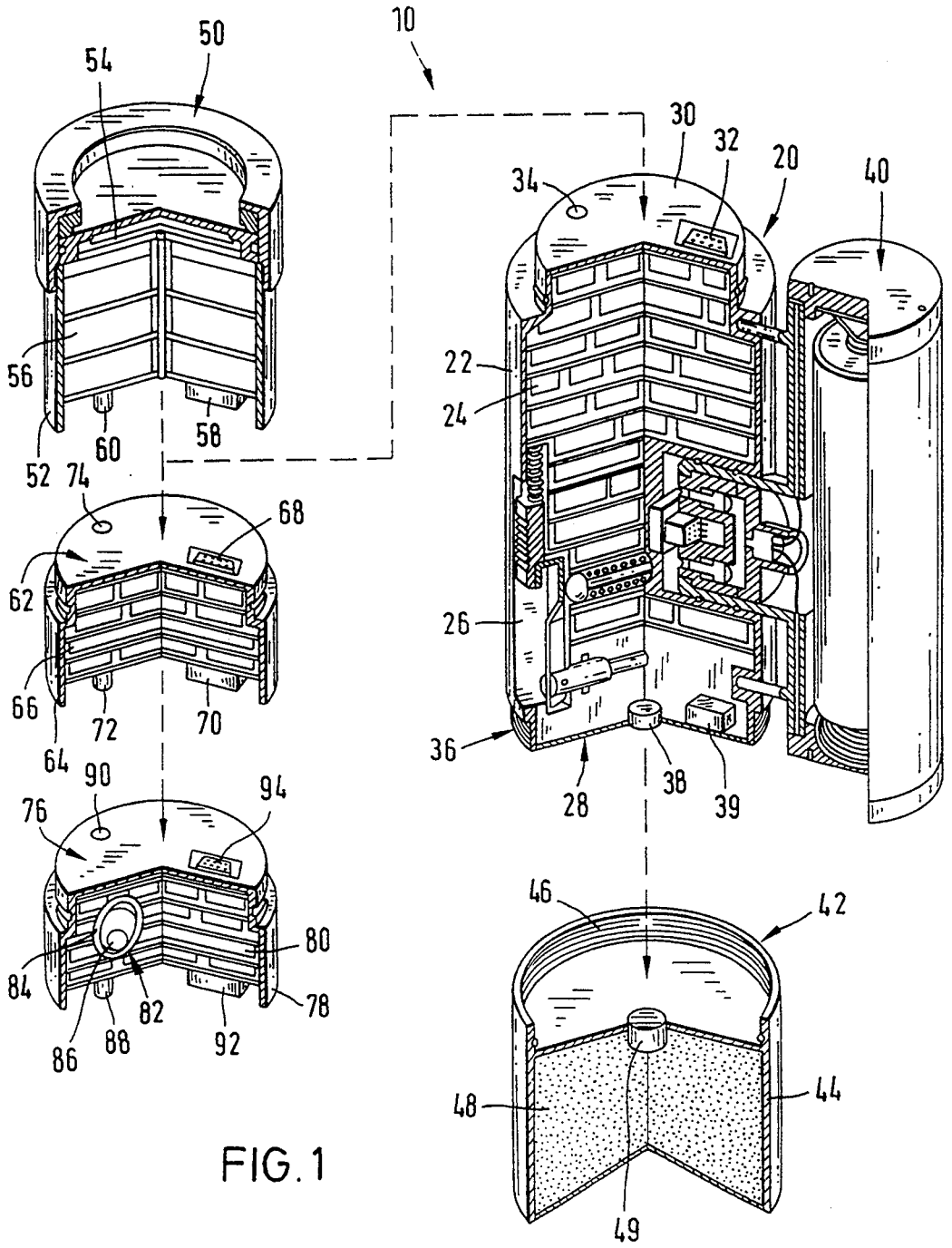
FIG. 1 is a cut-open view of an embodiment of a modular fuze according to the invention, showing the individual modules, likewise cut open.
Figure 3:
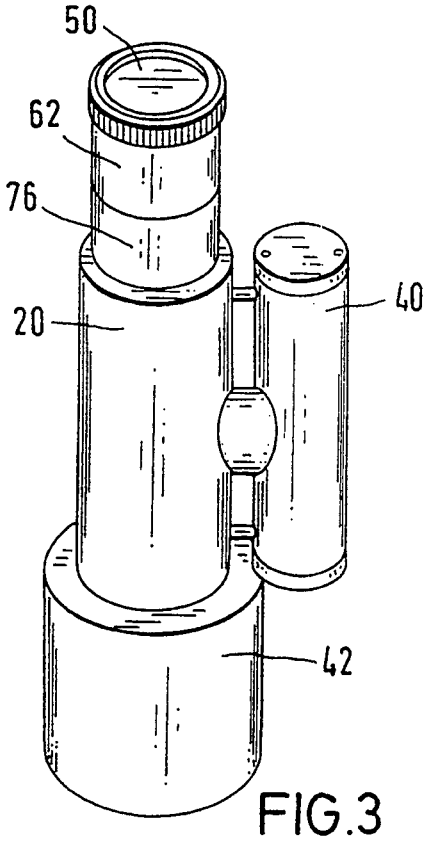

FIG. 3 is a perspective side view of the fuze according to FIG. 1 with a payload in a state in which it has been completed for use.

Figure 4:
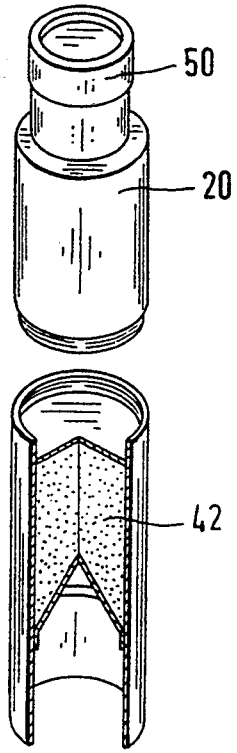

FIG. 4 shows the fuze of FIG. 1 with a shaped charge in a state in which it has been completed for use.

Figure 5:
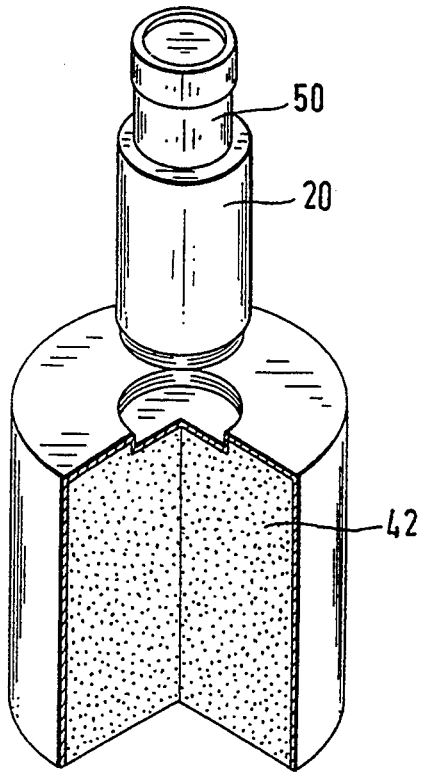

FIG. 5 shows the fuze according to FIG. 1 with an explosive charge in a state in which it has been completed for use.

Figure 6:
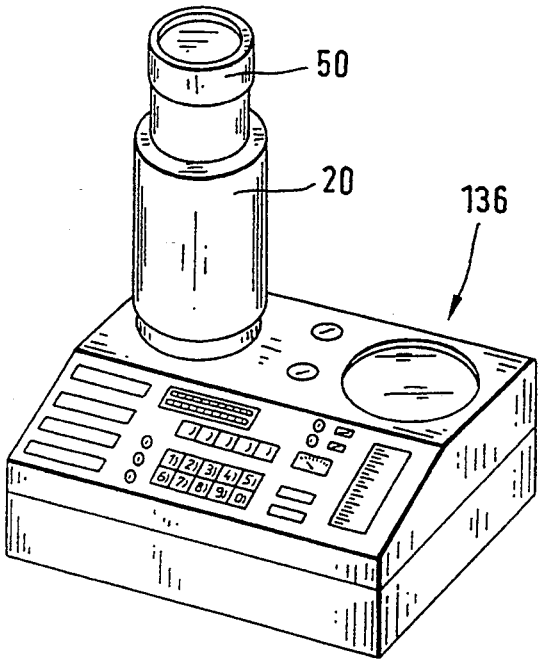

FIG. 6 shows the fuze of FIG. 1 which has been assembled of modules and is disposed on a programming device.

DETAILED DESCRIPTION OF THE PREFERRED EMBODIMENTS

Turning now to FIG. 1 there is shown a fuze 10 including a basic module 20, a first additional module 50, a second additional module 62 and a third additional module 76.

Basic module 20 includes an essentially cylindrical, watertight housing 22 containing a known electronic unit 24 that can be adjusted by programming as well as a mechanical safety device 26. The mechanical safety 26 acts on a mechanical double firing safety disposed in the housing 22 and configured in a known manner.

The circumferential surface of the housing 22 has a reduced diameter in the region of its two end surfaces or faces 28 and 30, with these diameters being different. A blind bore 34 is provided in the upper end face 30 of FIG. 1 in order to provide, in conjunction with pins 60, 72 or 88 of additional modules 50, 62, 76, for a precisely fitting attachment of the additional modules on the end of the basic module 20. In addition, an electrical plug-in socket 32 is provided in the end face 30 of basic module 20 with which basic module 20 is electrically connected with additional modules 50, 62 and 76.

The lower end face 28 of basic module 20 shown in FIG. 1 serves to connect it with either a payload 42 or a programming device 136 (see also FIG. 6). An external thread 36, for example, is here provided for the mechanical connection with the payload 42, with a corresponding internal thread 46 in housing 44 of payload 42 mating therewith. An ignition booster charge 38 to improve the initiation of an explosive substance 48 in payload 42 is additionally attached in the lower end face 28 of basic module 20. Although the ignition booster charge 38 is shown exemplarily as a centered charge in FIG. 1, it may also be arranged other than centered.

If the basic module 20, combined if desired with any number of additional modules 50, 62, 76, is to be placed onto programming device 136 (see FIG. 6), the electrical connection between basic module 20 and programming device 136 required for programming is established by way of an electrical connecting plug 39 provided in the lower end face 28 of basic module 20.

An energy supply 40 that can be plugged onto the side of basic module 20, and possibly also removed therefrom, serves to supply basic module 20, and the additional modules 50, 62, 76 possibly connected thereto, with energy.

FIG. 1 also clearly shows that basic module 20 can be connected with programming device 136 only if the payload 42 is not screwed on since, as shown in FIG. 6, a screwed-on payload 42 inevitably covers the electrical connecting plug 39 of the basic module 20 required for the connection with the programming device 136. The thus realized advantage in safe handling of the fuze is quite obvious.

The first additional signal receiving unit for remote initiation of the fuze, e.g., by a high frequency radio signal or by a sonar signal. Preferably, as shown, the module 50 is a sonar module including a housing 52, a hydrophone 54 preferably oriented in the axial direction and an electronic unit 56. If sonar module 50 is to be connected directly to basic module 20 the electrical connecting plug 58 of module 50 serves, as already mentioned, to couple the circuit 56 of module 50 to the plug-in socket 32 of basic module 20. A pin 60, which is provided on the end face of the sonar module 50 adjacent the plug 58 and which engages in blind bore 34 (or 74 or 90, respectively) in the end face 30 of basic module 20 (or of additional modules 62 and 76, respectively), takes care of the precise alignment of the mechanical connection of sonar module 50 with basic module 20 or with the additional modules 62 and 76 to be described below.

Sonar module 50 is intended for underwater use of fuze 10 and can be initiated by a signal generated by target vehicles as well as by a signal generated by a remote ignition sonar transmitter.

As shown in FIG. 1, the additional sonar module 50 has a watertight seal at the top. The sonar module 50, when used together with basic module 20, constitutes the direct termination of fuze 10 on the side facing away from the payload 42. If additional modules 62 and/or 76 are placed between module 50 and the basic module 20, module 50 always is the outermost module of fuze 10.

The second additional module 62 is a water depth module which is intended to produce a firing pulse as a function of a water depth range or a water pressure if fuze 10 is used underwater. An electronic unit 66 accommodated in a housing 64 of module 62 operates according to known principles, with the sensitivity of this additional module 62 being programmable for the desired water pressure range. Again a plug-in socket 68 and a connecting plug 70 are provided on the respective opposite end surface of the module 62 for the electrical connection with the other additional modules 50 or 76, respectively, or possibly for the connection with basic module 20, and a pin 72 and a blind bore 74 are provided in or at housing 64 for a mechanically accurate alignment with a precise fit.

The third additional module 76 is a position sensor module including a housing 78 having a programmable electronic unit 80 disposed therein. A position sensor 82 is disposed within this electronic unit 80. This sensor 82 is formed, for example, of a hollow ball 84 housing a freely movable ball 86 disposed therein. Hollow ball 84 is composed of a plurality of electrically insulated hollow ball segments which are connected with electronic unit 80 by individual conductors. Ball 86 is manufactured of electrically conductive material and its diameter is selected in such a way that in every position it contacts at least two of the hollow ball segments of hollow ball 84. Ball 86 thus short-circuits two different pairs of hollow ball segments in dependence on its position or a change in its position, so that, if the entire position sensor module 76 changes its position and thus fuze 10 changes its position, this change can be detected by electronic unit 80. An ignition pulse is then initiated as a function of the parameters programmed into electronic unit 80. In this third additional module 76 as well, a connecting plug 92 and a plug-in socket 94 serve as the electrical connection with basic module 20 or with an attached additional module 50 or 62. An accurately fitting mechanical connection is established analogously to the other modules 20, 50 and 62, by a pin 88 and a blind bore 90.

Fuze 10, which may be composed of different combinations of basic module 20 with additional modules 50, 62, and 76, depending on its desired use, is thus designed, among others, also for underwater use. Therefore it is a matter of course, that a reliable, mechanically firm and waterproof connection is made possible in the connection regions between the individual modules for which purpose spring rings and sealing rings, preferable 0-rings, are employed. If basic module 20 is to be employed by itself for a specific purpose, that is, without additional modules, a cover (not shown in detail here) is provided which covers and seals the connecting region and the upper end face 30 of basic module 20 in a watertight manner.

Figure 2:
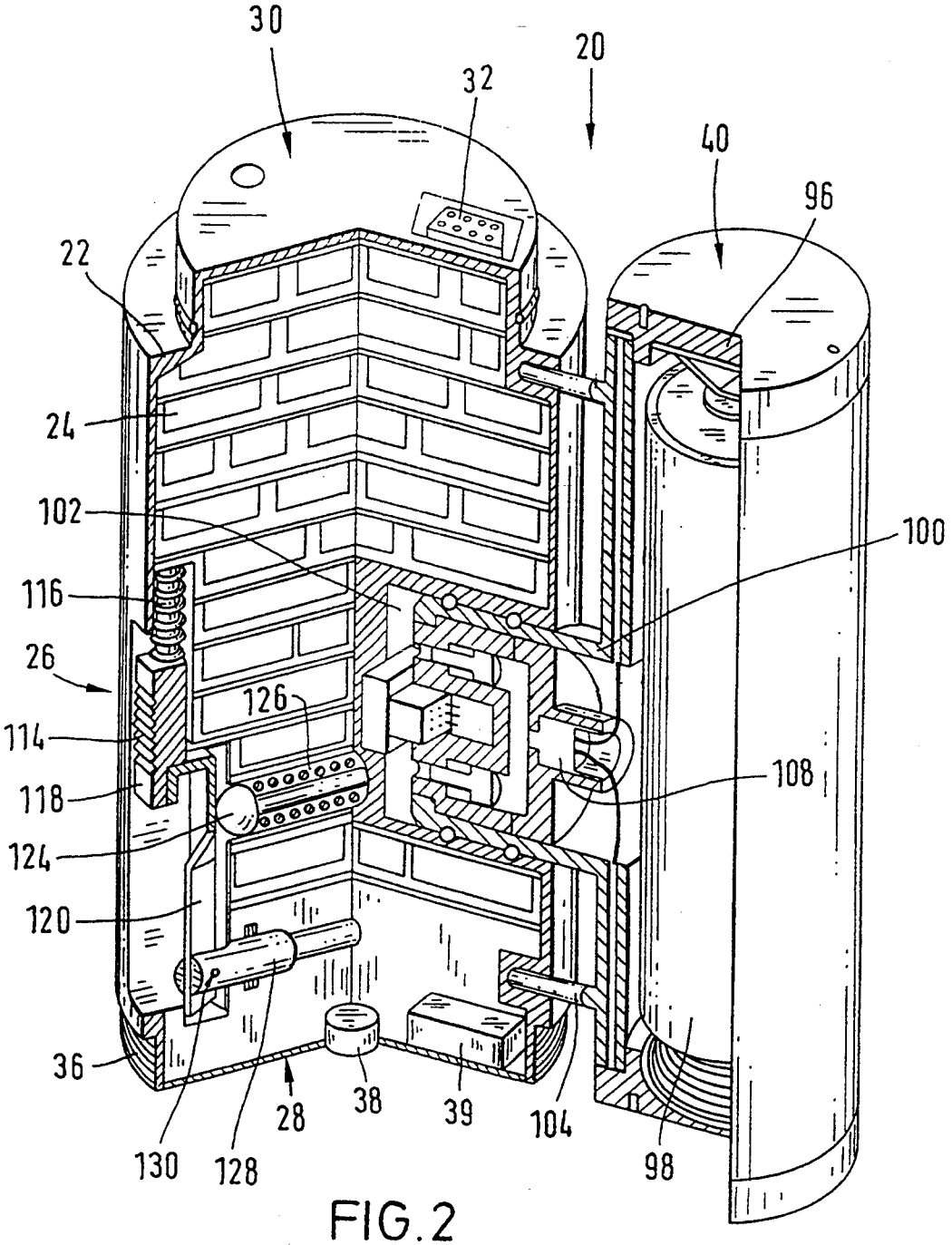
FIG. 2 is an enlarged view of the basic module of the fuze according to FIG. 1.
Figure 2A:
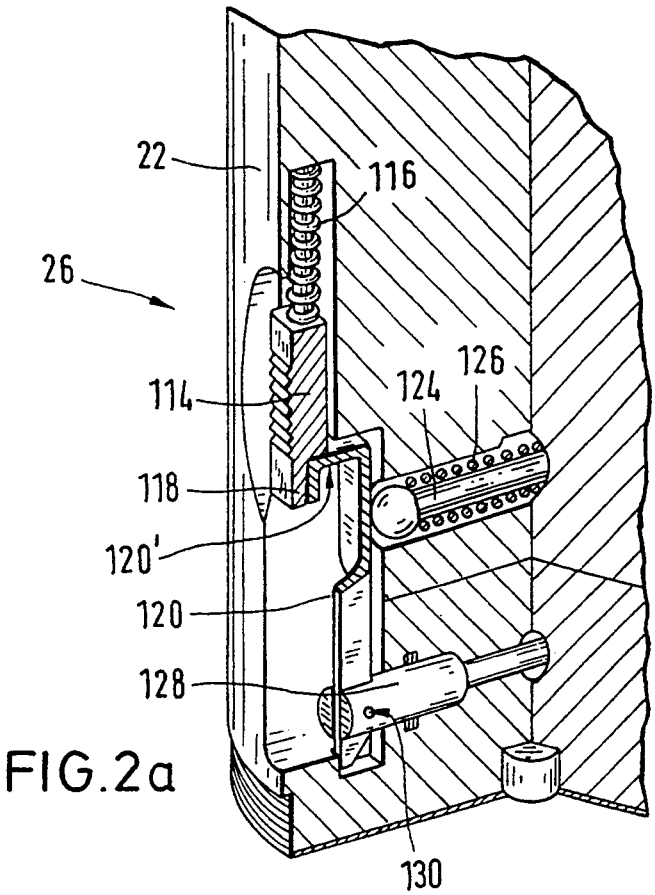
Figure 2B:
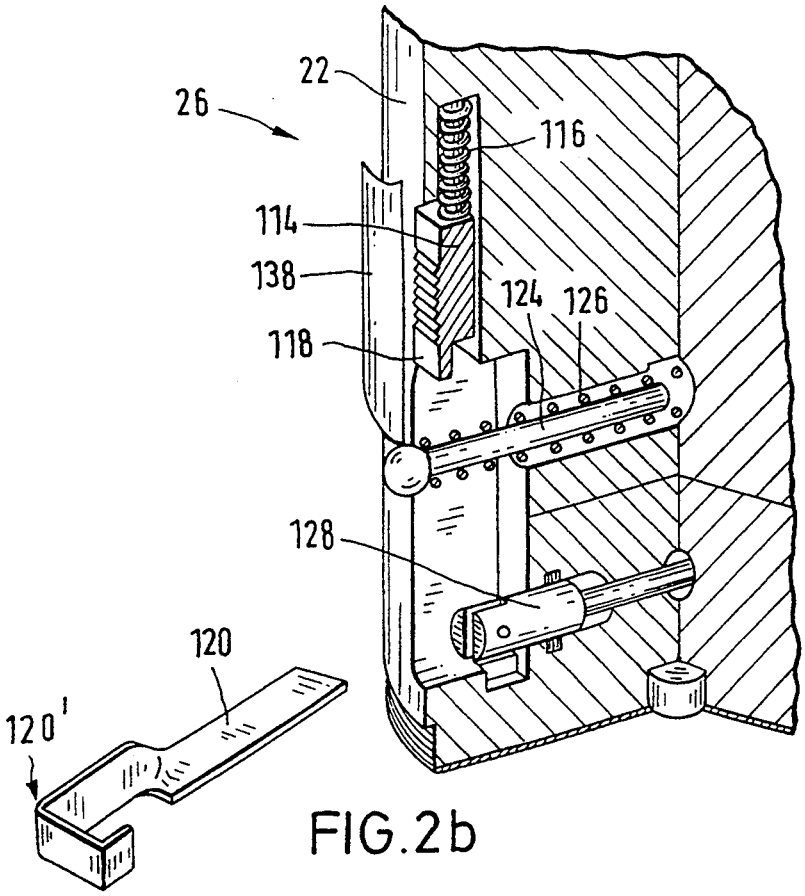

As can be clearly seen in FIGS. 2, 2*a* and 2*b* the safety device 26, in the illustrated embodiment, includes a slide 114 which is inserted into a corresponding guide or recess in the circumferential surface of the housing 22 of basic module 20 and can be manually pushed out of its rest position (safety position) in a direction substantially parallel to the longitudinal axis of the housing 22 against the force of a compression spring 116. Slide 114 is provided with a holding edge 118 which, when slide 114 is in the rest position, constitutes an abutment for one end of a pull lever 120, more precisely, an abutment for an L-shaped front section 120' at one end of the pull lever 120.

In the safety position shown in FIGS. 2 and 2*a*, the longer leg of L-shaped section 120' presses against a safety pin 124 which is mounted in the housing for substantially radial movement and which is also charged by a compression spring 126. At its end opposite the L-shaped section 120', pull lever 120 is connected by way of a rotary/pivot joint 130 with a detent pin 128 which in turn acts on a mechanical ignition or firing timer (not shown here) in basic module 20.

Detent pin 128 is advisably charged by external pressure from both sides so that, primarily under the force of water pressure, pressure equalization takes place, enabling detent pin 128 to be pulled toward the outside.

To release the safety, as shown in FIG. 2*b*, the slide 114, which is provided with a securely grippable surface, is pushed upward, thus causing its holding edge 118 to release pull lever 120. The spring charged safety pin 124 urges pull lever 120 toward the outside. The lever 120 is then able to pivot in joint 130 and can be pulled after its axially rotational fixation has been released. The release of pull lever 120 permits the detent pin 128 to be pulled outwardly (or if spring, charged the detent pin 128 to be pushed outwardly) so as to release the mechanical ignition timer.

Because of the safety pin 124 that is released when the safety is released and which jumps outwardly to beyond the outer diameter of housing 22, it becomes impossible to repackage basic module 20. A package 138, shown schematically in FIG. 2*b* as an example, and for example a paper casing, can be pushed over basic module 20 only after it has again been made completely safe, that is, after pull lever 120 has been reinserted and has again be secured by slide 114.

The separate energy supply 40 pushed laterally onto basic module 20 is essentially composed of a housing 96, containing a battery 98 as well as the necessary connecting contacts and possibly holders. Preferably, battery 98 is of the type that has a long storage life, for example, a lithium battery.

Housing 96 is provided with a central connecting plug 100 which is inserted into a corresponding radial recess 102 in basic module housing 22. In order to ensure its secure mechanical and water-tight connection, a spring ring and an 0-ring are provided in the connection region between connecting plug 100 and recess 102.

As indicated above, the fuze 10 is designed to be particularly safe since, in addition to the firing or ignition timing, an adjustable desensitization time, that is, a maximum service life/function duration of the fuze 10 after it has been armed, is also provided, and that once the instant of desensitization has been reached, the electrical connection between the energy supply 40 and the fuze 10 is severed. This precludes further supply of energy to the fuze 10, so that ignition or firing can no longer take place, and the fuze 10 is disarmed. For this purpose, a pyrotechnic charge 108 is disposed within the plug 100 and electrically connected to the electronic unit 24. This charge 108 serves to sever at least the electrical connection between the energy supply 40 and the basic module 20 at the end of the desensitization time programmed into the electronic unit 24.

FIGS. 3, 4 and 5 show the universal usability of fuze 1 which, as an example, is assembled from various modules for each respective use.

In preparation for use, the modules selected for the particular application, which are welded in an air-tight manner, and at least basic module 20 as well as a separately stored battery 98 and a payload 42 or some corresponding primer charge are removed from their airtight packages and energy supply 40 is connected to basic module 20 to supply power from battery 98 to the connected electronic circuits. Then basic module 20 is placed onto programming device 136 as shown in FIG. 6. After programming device 136, which may be configured as a portable or stationary programming device, has been turned on, the desired ignition or firing time is set by way of the keyboard. The firing time can preferably be set with an accuracy of at least 1% between 0.1 and 99.9 hours in steps of 0.1 hours. If necessary, it is also possible to realize programming in minutes, hours and days up to a maximum of 30 days.

The thus stored firing time preferably appears on an appropriate lighted display of the device 136 and may be transferred, if required after confirmation by further keyboard input, to the electronic firing unit or system 24 of basic module 20, where it is stored and processed, to then be immediately displayed for monitoring on a preferably provided second display of programming device 136. If the thus controllable desired and actual values of the put-in firing time should not coincide, the firing time input may be erased and a new firing time may be input. Then fuze 10, in its combination of basic module 20 in conjunction with the modules selected for the particular use, is removed from programming device 136 and combined with a payload 42.

At the actual location of use, detent pin 128 is pulled as described in connection with FIGS. 2*a* and 2*b*, thus activating all firing functions (in dependence on the employed modules, that is, delayed, position-dependent or remote ignition). As already mentioned, the pulled detent pin 128 releases a mechanical or electronic timer which, in a known manner, serves to control a dead time of approximately ten minutes. During this dead time, a combat swimmer or engineer putting the respective charge in position is able to move to a safe distance. After expiration of the dead time it is no longer possible to deactivate fuze 10.

The invention now being fully described, it will be apparent to one of ordinary skill in the art that any changes and modifications can be made thereto without departing from the spirit or scope of the invention as set forth herein.

What is claimed is:

1. A modular fuze for a payload which is independent of a weapon system and is not ammunition specific, said modular fuze comprising:

a basic module having an essentially cylindrical water tight housing with first and second end surfaces;

an adjustable electronic unit for controlling the firing time of the fuze disposed in said housing;

first connecting means disposed in the region of said first end surface of said housing for mechanically connecting said housing and functionally connecting said electronic unit with one of a programming device for programming a firing time and a desensitization time into said electronic unit, and the payload;

second connecting means disposed in the region of said second end surface of said housing for mechanically connecting said housing and electrically connecting said adjustable electronic unit to a housing and electronic circuit, respectively, of at least one additional module for the fuze;

a mechanical safety device, disposed in said cylindrical housing of said basic module and deactivatable from the exterior of said housing, for preventing firing of the payload when it is connected to said housing until the mechanical safety device is deactivated;

a separate energy supply; and means for mechanically and electrically connecting said energy supply with said housing of said basic module and with said adjustable electronic unit.

2. A fuze as defined in claim 1, wherein said first and second connecting means are configured differently such that a payload cannot be connected with said second connecting means and the additional module cannot be connected with said first connecting means.

3. A fuze as defined in claim 2, wherein said first and second connecting means comprise respective regions of different reduced diameters formed on a peripheral surface of said cylindrical housing adjacent respective said first and second end surfaces and a respective electrical plug provided in each of said first and second end surfaces.

4. A fuze as defined in claim 3, wherein said region of reduced diameter of said first connecting means is provided with a thread for engaging an internal thread the a payload.

5. A fuze as defined in claim 2, further comprising the additional module connected with said basic module at said second end surface of said cylindrical housing, with said additional module including a signal receiving unit for remote initiation of said fuze.

6. A fuze as defined in claim 5 wherein said receiving unit is a sonar sensor.

7. A fuze as defined in claim 5, wherein at least one further module consisting of at least one of a water depth dependent sensor and a position sensor is mechanically and electrically connected between said basic module and said additional module.

8. A fuze as defined in claim 7 wherein said receiving unit is a sonar sensor.

9. A fuze as defined in claim 5, wherein said modules are electrically interconnected such that after attachment of a complete fuze to a programming device, all of said modules can be addressed by the programming device and, depending on a desired use of the fuze, desired firing parameters for each said module and hierarchy of firing pulses generated by them can be programmed.

10. A fuze as defined in claim 1, wherein said means for mechanically and electrically connecting said energy supply comprises a plug-in connection between said basic module and said energy supply; and further comprising a pyrotechnic charge means, disposed within said plug in connection and electrically connected to said adjustable electronic unit, for severing at least the electrical connection between said energy supply and said basic module at an end of a desensitization time programmed into said adjustable electronic unit.

11. A fuze as defined in claim 1 wherein said mechanical safety device includes a detent pin which acts on an ignition and safety mechanism disposed in said basic module and which is releasably connected with one end of a pull lever via a rotary/pivot joint.

12. A fuze as defined in claim 11, wherein: said pull lever is normally disposed in a recess provided in the circumferential surface of said cylindrical housing and is held in a safety position by a spring charged slide which is mounted in said recess for movement substantially parallel to a longitudinal axis of said housing and which engages an end of said pull lever opposite said one end; a spring charged safety pin is mounted in said housing for substantially radial movement and engages said opposite end of said pull lever when said pull lever is in said safety position, said safety pin causing said opposite end of said pull lever, when released by said slide, to pivot about said joint and extend beyond said circumferential surface of said basic module housing so as to be functionally manipulated.

13. A fuze as defined in claim 12, wherein, after causing pivoting of said pull lever, said safety pin projects out of said recess and beyond said circumferential surface of said housing of said basic module to an extent such that renewed packaging of the no longer safe basic module is prevented without resetting of said safety pin.

* * * * *